US006994496B2

(12) United States Patent
Mills

(10) Patent No.: US 6,994,496 B2
(45) **Date of Patent: *Feb. 7, 2006**

(54) ROOF BOLTS FOR USE IN MINES, A METHOD FOR THEIR PRODUCTION AND A METHOD FOR THEIR INSTALLATION

(75) Inventor: Peter S. Mills, Stamping Ground, KY (US)

(73) Assignee: Minova International Limited, Chipping Norton (GB)

( * ) Notice: Subject to any disclaimer, the term of this patent is extended or adjusted under 35 U.S.C. 154(b) by 13 days.

This patent is subject to a terminal disclaimer.

(21) Appl. No.: 10/434,126

(22) Filed: May 9, 2003

(65) Prior Publication Data

US 2003/0210967 A1 Nov. 13, 2003

Related U.S. Application Data

(60) Provisional application No. 60/379,108, filed on May 10, 2002.

(51) Int. Cl.
*E21D 20/00* (2006.01)
*E21D 21/00* (2006.01)
*F16B 39/00* (2006.01)

(52) U.S. Cl. ..... 405/288; 405/259.1; 405/259.4; 405/302.1; 411/5; 411/54; 411/134

(58) Field of Classification Search .. 405/259.1–259.4, 405/288, 302.1; 411/5, 134, 71–74, 54; 299/11, 299/31

See application file for complete search history.

(56) References Cited

U.S. PATENT DOCUMENTS

| | | | | | |
|---|---|---|---|---|---|
| 4,031,936 | A | * | 6/1977 | Curtis | 411/134 |
| 4,514,111 | A | * | 4/1985 | Issakainen | 405/259.5 |
| 4,557,631 | A | * | 12/1985 | Donan et al. | 405/259.3 |
| 5,078,547 | A | * | 1/1992 | Calandra et al. | 405/259.5 |
| 5,222,835 | A | * | 6/1993 | Wright | 411/534 |

FOREIGN PATENT DOCUMENTS

| | | | |
|---|---|---|---|
| DE | 3643522 | * | 6/1988 |
| WO | 03023190 | * | 3/2003 |

* cited by examiner

*Primary Examiner*—Jong-Suk (James) Lee
(74) *Attorney, Agent, or Firm*—Nixon & Vanderhye, P.C.

(57) ABSTRACT

The invention comprises a roof bolt and nut in screw threaded engagement, said bolt comprising a shaft for insertion in a hole drilled in a mine roof and a threaded portion engaged by the nut whereby the bolt may be rotated. The nut is offset with respect to the longitudinal axis of the shaft of the bolt so that when the bolt is rotated by means of the nut, the bolt is caused to describe a circle of greater diameter than its own diameter, the amount of said offset being from about 0.015 to about 0.50 inches. Preferably the offset is from about 0.02 to about 0.25 inches.

The nut may be releasably locked in screw threaded engagement with the bolt so that the bolt can be rotated by means of the nut and above a selected torque the nut will break out.

9 Claims, 3 Drawing Sheets

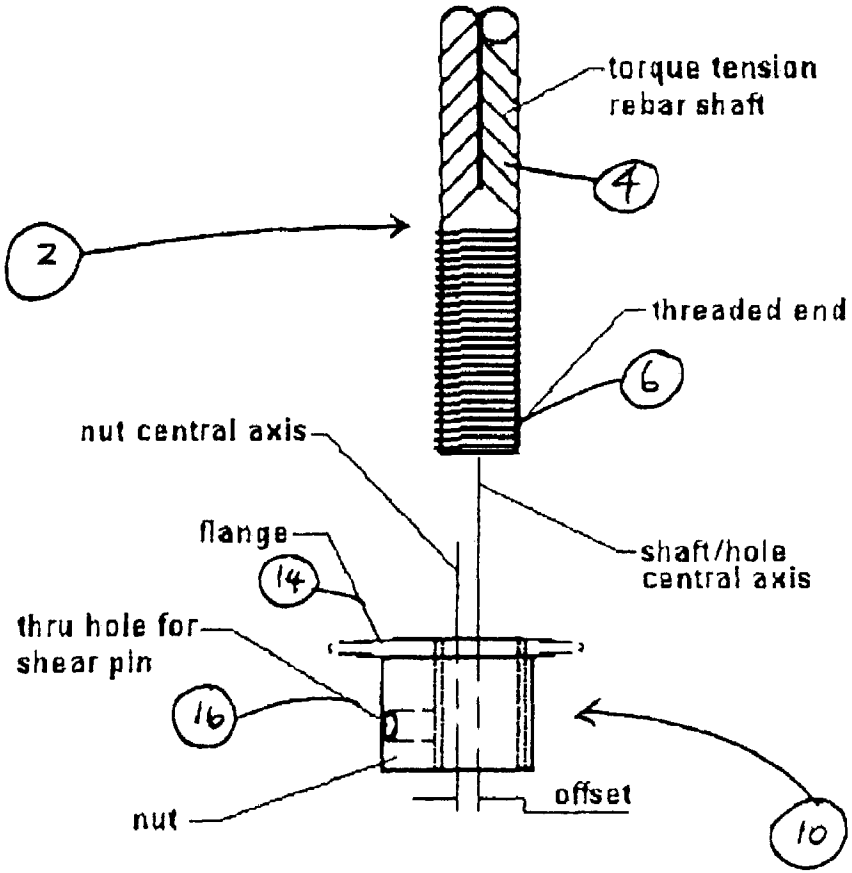
FIGURE 1: Front View
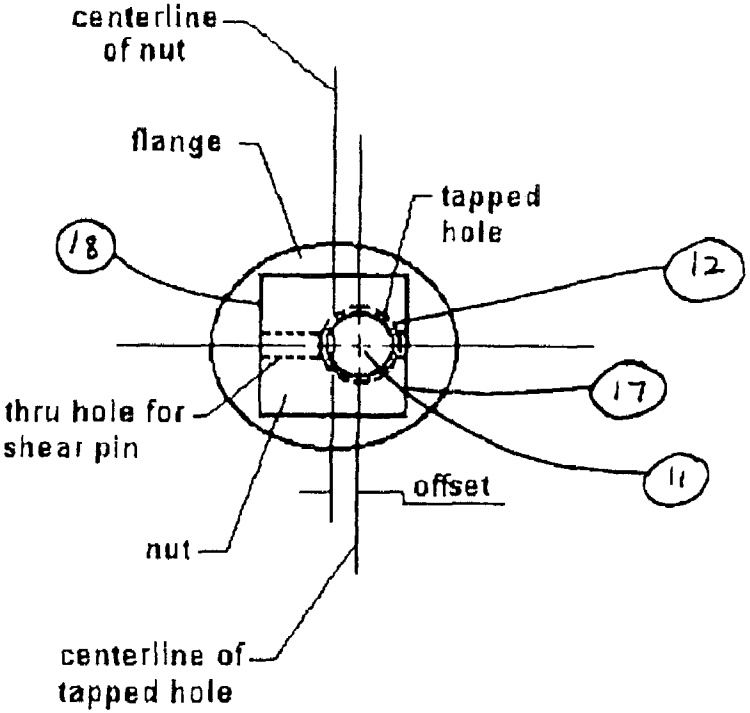
FIGURE 2: Bottom View

CONCEPTUAL SCHEMATIC OF THE ECLIPSE ROOF BOLT CHUCK ADAPTER a) Typical co-axial alignment of system components.

b) Offset between bolt and hole central axes created by the Eclipse chuck adapter ( offset incorporated at plane "Z" ).

ROOF BOLTS FOR USE IN MINES, A METHOD FOR THEIR PRODUCTION AND A METHOD FOR THEIR INSTALLATION

CROSS-REFERENCE TO RELATED APPLICATION

This application claims the benefit of Provisional Application No. 60/379,108, filed May 10, 2002, the entire content of which is hereby incorporated by reference in this application.

FIELD OF THE INVENTION

This invention relates to equipment for use in mines, more particularly to roof bolts incorporating a novel construction of nut, to a method for their production and to a method for their installation.

BACKGROUND OF THE INVENTION

Roof bolts are well known in the mining industry and are extensively employed for consolidating the roof and providing anchoring points and support.

Their use involves drilling a hole in the roof of the mine and inserting into the hole a resin filled cartridge. The resin filled cartridges are also well known and comprise a curable resin and a catalyst for the resin contained in a sausage-like skin. In the next step of the installation a bolt is inserted which pierces the skin and penetrates the resin. The bolt is then usually spun about its axis to mix the resin and catalyst and, once mixed, the resin cures and sets.

In mines in some parts of the world for example in Australia it is the normal practice to apply tension to the bolt after the resin has set. This may is done by providing a screw threaded portion on the bolt and screwing a nut onto the threaded portion to abut a bearing plate against the rock surface. The nut is tightened until a chosen torque is reached, which is normally 120 to 150 ft lbs. This results in tension between the anchored part of the bolt and the bearing plate.

The final step in the installation procedure is therefore to tighten up the bolt against the plate. However the nut is usually locked onto the bolt so that the nut and bolt can be rotated together to mix the resin during the mixing stage of the installation and a mechanism is provided to cause the nut to break out, as it is called, when a certain torque leas been reached. In this way, once the bolt is securely anchored by the resin, further rotation of the nut, usually by means of a drilling machine, causes the locking mechanism to break and the nut can then be tightened up against the bearing plate. Many different nut break out systems are already known in the art. An example is described in U.S. Pat. No. 6,296,429 B1.

In countries such as the USA, the usual practice is to employ a bolt that has neither a thread nor a nut but which has a head by means of which it is rotated in the hole. Applying tension by tightening up a nut on the bolt is not usually considered necessary.

Problem To Be Solved By the Invention

For both bolts which are tensioned by tightening up a nut and those which are not, there is a long standing problem which is called glove fingering.

Insertion of the bolt into the hole containing the cartridge causes pressure on the cartridge which forces the skin to the hole wall. The bolt bores a hole through the contents of the cartridge leaving the skin substantially intact This results in a reduced direct contact by the resin with the wall of the hole and hence a less than optimum anchorage.

As mentioned above, in the USA bolts are usually employed having neither a thread nor a nut and in mining operations in the USA a frequently used bolt is one which is about ⅝ (five eighths) of an inch in diameter routinely employed in a hole which is about 1 (one) inch in diameter. Another frequently used combination in the USA is a ⅞ (seven eighths) inch diameter bolt in a 1 (one) and ⅜ (three eighths) inch diameter hole.

In Australia using a threaded bolt which is subsequently tensioned, a typical operation will use a bolt which is 22 mm in diameter in a hole of 28 mm in diameter. Glove fingering is a problem encountered with all of these combinations of sizes of bolt and hole.

Previous attempts to solve the problem have involved the use of a thinner skin to contain the resin, coarse filler in the cartridge and slash cut bolts. However these have generally achieved only limited success.

Our pending U.S. Provisional Patent Application No. 60/318637 describes a solution to the problem for bolts having a head and which are not subsequently tensioned by causing the bolt, when it is rotated or spun by means of its head, to describe a circle of diameter greater then its own diameter. One embodiment of the invention described in that application is a novel form of roof bolt in which the head of the bolt is offset with respect to the axis of its shaft by at least 0.08 inches.

The present invention provides a solution to the problem of glove fingering in the case of threaded bolts which are to be tensioned by means of a nut. The problem is solved by a novel construction of nut which causes the bolt, when rotated, to describe a circle of diameter greater than its own diameter.

SUMMARY OF THE INVENTION

According to the present invention there is provided a roof bolt and nut in screw threaded engagement, said bolt comprising a shaft for insertion in a hole drilled in a mine roof and a threaded portion engaged by the nut whereby the bolt may be rotated and wherein the nut is offset with respect to the longitudinal axis of the shaft of the bolt so that when the bolt is rotated by means of the nut, the bolt is caused to describe a circle of greater diameter than its own diameter, the amount of said offset being from about 0.015 to 0.50 inches, preferably from about 0.02 to 0.25 inches, more preferably from about 0.08 to 0.16 inches.

ADVANTAGEOUS EFFECT OF THE INVENTION

The effect of the offset is that when a bolt is rotated by means of the nut, the shaft is caused to rotate about an axis which is offset with respect to its longitudinal axis and describe a circle of diameter greater than its own diameter.

The result is to rupture the skin of the cartridge more effectively and thereby improve the contact of the resin with the wall of the hole. In addition mixing of the cartridge resin and catalyst contents is improved resulting in an improved anchorage.

BRIEF DESCRIPTION OF THE DRAWINGS

FIG. 1 is a side view partly in section of the bolt and nut and

FIG. 2 is a bottom view of the nut.

DETAILED DESCRIPTION OF THE INVENTION

Figures 3, 4:
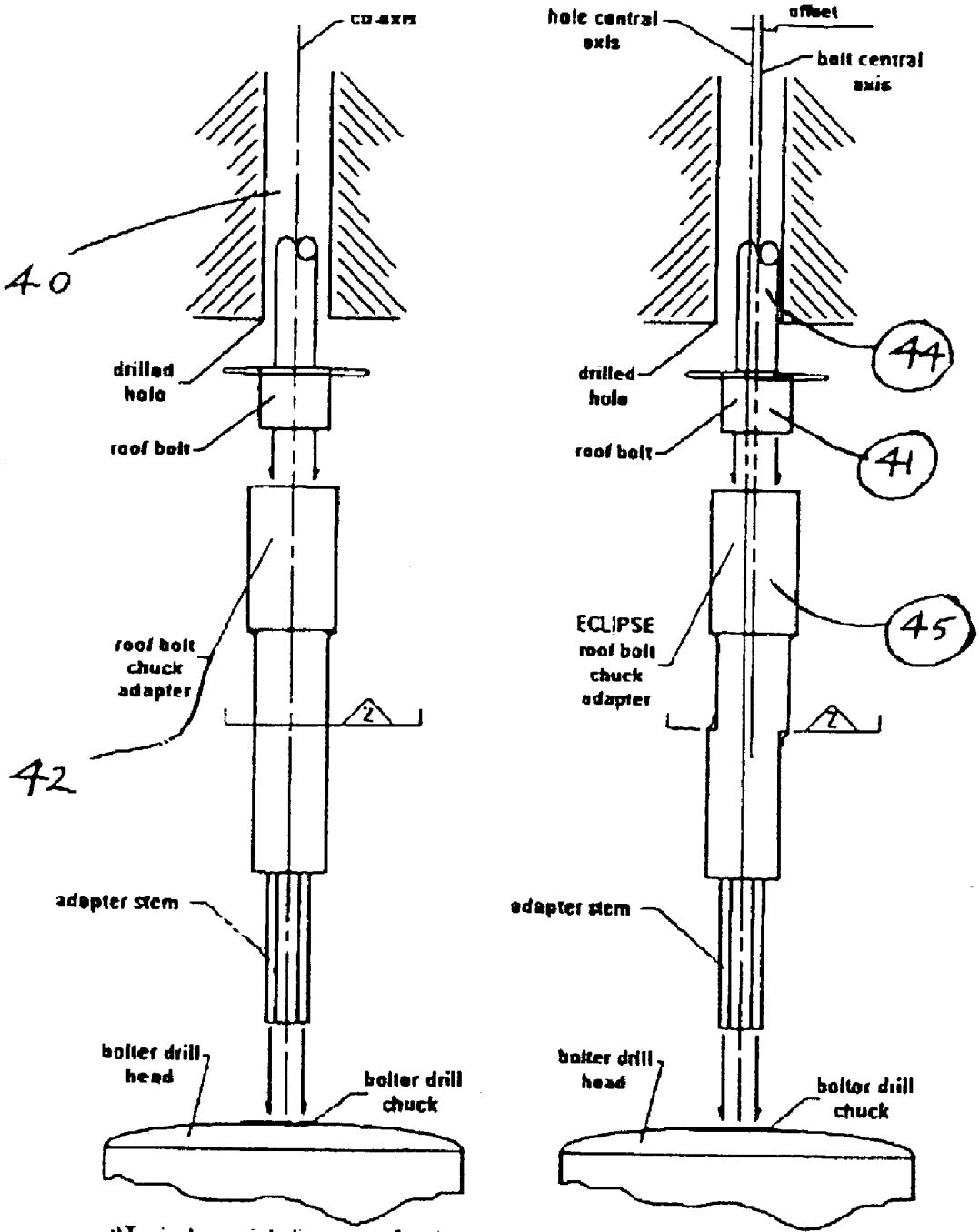
FIG. 3 shows a conventional drilling arrangement.
FIG. 4 shows a drilling arrangement including a chuck adapter that enables nuts not having an offset to be used in accordance with the present invention and FIGS. 5, 6 and 7 illustrate steps in the measurement of the offset of a nut.

The term roof is intended to embrace all surfaces of a mine such as wall and floor as well as overhead surfaces.

The term mine is intended to include all underground workings and quarries including tunnels.

References to the nut being offset refer to the centre of the threaded hole in the nut being displaced with respect to the centre of rotation of the nut when the nut is engaged with the thread on a bolt and the bolt and nut are rotated together by means of the nut.

The degree of offset is measured by the method described in the present specification. The terms central axis and longitudinal axis are used interchangeably.

According to another aspect of the present invention there is provided a method for the production of nuts for roof bolts which method comprises:

(i) casting a molten metal in the shape of a nut and (ii) tapping a thread through the cast metal in a manner such that the centre of the tapped hole is offset from the central axis of the nut by from 0.015 to 0.50 inches preferably from 0.02 to 0.25 inches, more preferably from 0.08 to 0.16 inches.

A hole may also be drilled to receive a shear pin.

Roof bolts of the type mentioned above which have neither a thread nor a nut but which have a head by means of which they are rotated in the hole, are sometimes found to have their head offset by a small amount. The offset is unintended and arises because of the tolerances employed in their process of manufacture. However the offset has been found never to exceed 0.07 inches and our pending U.S. Provisional Patent Application No. 60/318637 which described bolts having an offset of greater than this figure also describes a novel chuck that enables conventional roof bolts (that is bolts having an offset less than 0.07 inches or no offset at all) to be used in a manner that reduces glove fingering. The novel chuck is adapted to rotate the bolt so that the shaft of the bolt is rotated about an axis which its offset from its own axis. The novel chuck enables conventional nuts i.e. nuts having little or no offset to be used in the present invention to reduce glove fingering.

Thus, according to a further aspect of the present invention a system for roof bolting comprises means for holding and rotating a roof bolt, said means including a chuck for holding the roof bolt and wherein the chuck is adapted to rotate the bolt about an axis which is offset with respect to the central axis of the shaft whereby the shaft is caused to describe a circle of diameter greater than its own diameter.

Preferably the chuck is adapted to rotate the bolt by means of a nut releasably locked in screw threaded engagement with the bolt.

Preferably the chuck is adapted so that the offset is from about 0.015 to about 0.50 inches preferably 0.02 to 0.25 inches, more preferably from about 0.08 to 0.16 inches.

According to another aspect of the invention a method for the installation of a roof bolt comprises:

(i) inserting a roof bolt having a nut releasably locked in screw threaded engagement therewith into a drilled hole, the drilled hole containing a cartridge comprising a curable resin and catalyst so that the bolt penetrates the curable resin and (ii) rotating the bolt by means of its nut to mix the resin and catalyst to effect mixing of the resin and where the axis of rotation is offset with respect to the longitudinal axis of the shaft of the bolt so that the bolt is caused to describe a circle of greater diameter than its own diameter and (iii) allowing the resin to set to anchor the bolt, and (iv) applying a rotational force to the nut to cause it to break out and continuing to rotate the nut to tension the bolt.

Usually there is a bearing plate in contact with the rock surface against which the nut is tightened.

According to another aspect of the present invention there is provided a novel nut suitable for use with roofbolts of the type having a threaded end portion said nut comprising a body having a tapped hole and where the central axis of the tapped hole is offset with respect to the central axis of the body of the nut, the amount of offset being from at least 0.015 to 0.50 inches preferably from about 0.02 to 0.25 inches more preferably from about 0.08 to 0.16 inches.

Referring to FIGS. 1 and 2 a roof bolt indicated generally by numeral 2 comprises a shaft 4 having a screw threaded end portion 6.

A nut indicated generally by numeral 10 has a tapped hole 11 having a screw thread 12, a flange 14 and a hole 16 for a shear pin (not shown) by means of which the nut 10 may be locked in position on the bolt 2 and used to rotate the bolt 2. The central axis of the tapped hole 11 is offset with respect to the central axis of the nut.

The nut has four flat sides, two of which arc numbered as 17 and 18 by means of which it can be rotated.

In use the nut 10 is screwed onto the threaded end portion 6 of the bolt 2 and a shear pin not shown inserted into hole 16 to engage the bolt tip and lock the nut in position and the bolt inserted into a drilled hole containing a resin cartridge. The bolt 2 is then rotated by means of the nut 10 to mix the resin and catalyst. The resin is allowed to set. Further torque applied to the nut 10 cause the shear pin to break and allow the nut to be tightened up to apply tension to the bolt 2.

Referring to FIGS. 3 and 4: a typical bolting cycle consists of (i) drilling a bore hole 40 (ii) lowering tie drill boom to retract the drill bit (or drill steel as it is commonly referred to in the industry), (iii) placement of the roof bolt chuck adapter 42 in the bolter drill chuck (iv) manually inserting the cartridge(s) (not shown) in the hole (v) manual advancement of the bolt tip 44 of roof bolt 41 into the hole 40 to retain the cartridge(s) in the hole (vi) placement of the head of the roof bolt 41 in the chuck adapter 42 (with roof plate (not shown) previously installed on the bolt) (vii) hydraulically raising the drill boom to fully insert the bolt 41 into the hole 40 and (viii) hydraulically actuating the bolter drill head to spin the bolt 41 to mix the resin.

Upon lowering the boom (step ii), the bolter drill chuck and bore hole should remain coaxial so that subsequent placement of the roof bolt chuck adapter and roof bolt ensures that all components of the system remain coaxial as well (refer to FIG. 3).

However where a $\frac{5}{8}^{th}$ inch bolt is inserted into a 1 inch hole, a ⅜ inch total annulus results. This annulus is considered large for a 1 inch hole and has been shown to significantly contribute to the problem of glove fingering, where the size of the annulus allows the bolt to bore through the central portion of the cartridge, leaving the cartridge film or skin intact between the resin contents of the cartridge and the hole wall.

Subsequent spinning of the bolt is often ineffective in shredding the film as the large annulus prevents the generation of a shear stress between the bolt surface and the film sufficient to pull the film away from the hole wall to be shredded.

In FIG. 4 there is shown a novel chuck adapter 45 which provides an offset between the axes of the hole/drill and the bolt 44 such that the former remains the axis of rotation, allowing a point on the outermost surface of the bolt to generate a circle of greater diameter than the bolt itself (diameter=bolt diameter+2× offset). This effectively decreases the annulus by twice the offset, thereby increasing mixing shear and improving the shredding of the film. This offset is shown diagrammatically as a shift in axis in plane "Z". This purely radial shift may be physically accomplished by cutting a typical adapter at "Z"0 perpendicular to its axis at some arbitrary distance from an end, and welding the portions back together at an offset in the radial direction. However, the offset may be achieved by various machining and manufacturing methods, utilizing a greater axial length of the adapter, so long as a resultant prescribed offset exists between the hole and the bolt axes.

Measurement of Offset.

An accurate method of measuring the offset is described with reference to FIGS. 5, 6 and 7.

Figures 5, 6, 7:
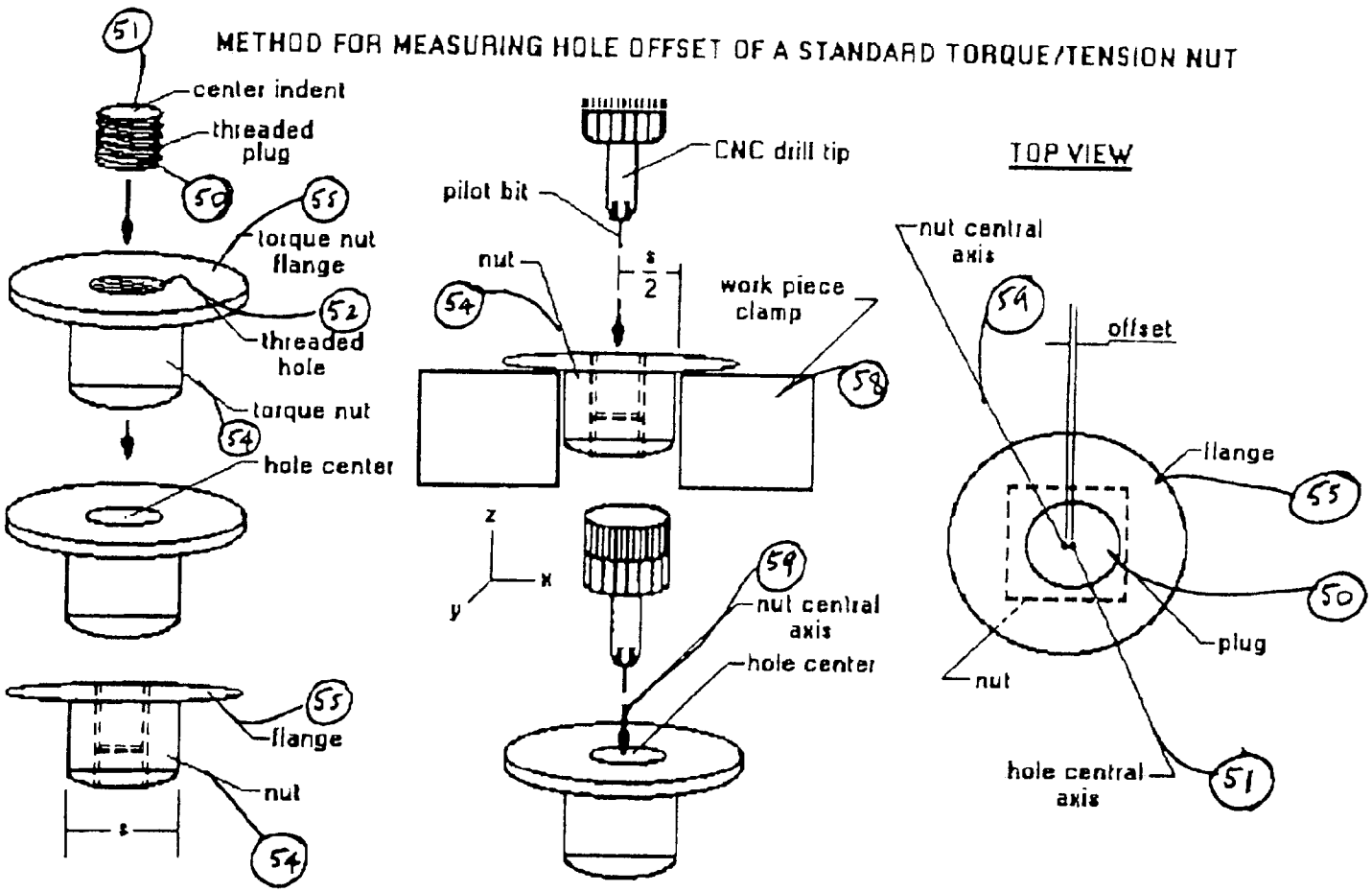

Referring to FIG. 5: a threaded plug 50 is advanced into the threaded hole 52 of the nut 54. The plug 50 has a central indent 51 which may be a small pilot hole located and drilled to just penetrate the surface via a CNC drill press. With the plug 50 inserted the indent 51 represents the central axis of the hole 52. The width of the nut s is measured at the flange 55.

Referring to FIG. 6: with the nut 54 secured in the work piece clamp 58 of the CNC drill press, the value s/2 is programmed into the controller as the desired x and y coordinates with an appropriate corner of the nut as the origin. The point (x,y)=(s/2, s/2) locates the central axis of the nut. An indent 59 (which is on the central axis of the nut) is drilled using the pilot bit.

Referring to FIG. 7: the offset between the hole and the nut central axes can then be accurately measured using a micrometer as the distance between the indents: indent 51 which represents the central axis of the threaded hole and indent 59 which represents the central axis of the nut.

What is claimed is:

1. A roof bolt and nut in screw threaded engagement, said bolt comprising a shaft, having a longitudinal axis for insertion in a hole drilled in a mine roof and a threaded portion engaged by the nut whereby the bolt may be rotated and wherein the nut is offset with respect to the longitudinal axis of the shaft of the bolt so that when the bolt is rotated by means of the nut, the bolt is caused to describe a circle of greater diameter than its own diameter, the amount of said offset being from about 0.015 to about 0.50 inches, and wherein the nut is releasably locked in screw threaded engagement with the bolt so that the bolt can be rotated by means of the nut.

2. The roof bolt as claimed in claim 1 wherein the offset is from about 0.02 to about 0.25 inches.

3. The roof bolt as claimed in claim 1 wherein the nut breaks out of being releasably locked in screw threaded engagement with the bolt above a selected torque.

4. A system for roof bolting, said system comprising a roof bolt, a nut releasably locked in screw threaded engagement with the bolt, and means for rotating the roof bolt, said means including a chuck for holding the end of the roof bolt and adapted to rotate the bolt by means of the nut, said bolt comprising a threaded shaft having a central axis and wherein the chuck is adapted to rotate the bolt so that the shaft of the bolt rotates about an axis which is offset with respect to the central axis of the shaft whereby the shaft is caused to describe a circle of diameter greater than its own diameter.

5. A system as claimed in claim 4 wherein the chuck is adapted so that the offset is from about 0.015 to about 0.50 inches.

6. A roof bolt and nut in screw threaded engagement, said bolt comprising a shaft with a longitudinal axis, for insertion in a hole drilled in a mine roof and a threaded portion engaged by the nut whereby the bolt may be rotated and the nut is releasably locked in screw threaded engagement with the bolt so that the bolt can be rotated by means of the nut and above a selected torque the nut will break out, and wherein the nut is offset with respect to the longitudinal axis of the shaft of the bolt so that when the bolt is rotated by means of the nut, the bolt is caused to describe a circle of greater diameter than its own diameter, the amount of said offset being form about 0.02 to about 0.25 inches.

7. A system for roof bolting, said system comprising a means for rotating a roof bolt, said means including a chuck for holding an end of the roof bolt, said bolt comprising a shaft having a central axis, and wherein the chuck is adapted to rotate the bolt by means of a nut which nut is releasably locked in screw threaded engagement with the bolt so that the shaft of the bolt rotates about an axis which is offset with respect to the central axis of the shaft whereby the shaft is caused to describe a circle of diameter greater than its own diameter, the amount of said offset being from about 0.02 to about 0.25 inches.

8. A nut suitable for use with roof bolts of the type having a threaded end portion, said nut comprising a body having a tapped hole and where the central axis of the tapped hole is offset with respect to the central axis of the body of the nut, the amount of offset being from at least 0.015 to 0.50 inches, and wherein the nut further comprises means for releasably locking the nut to a roof bolt.

9. A nut as claimed in claim 8, wherein the amount of offset is from about 0.02 to 0.25 inches.

* * * * *